US008905771B2

(12) United States Patent
Tsai

(10) Patent No.: US 8,905,771 B2
(45) Date of Patent: Dec. 9, 2014

(54) STRUCTURE OF TREE-SHAPED LIGHTING DECORATION

(71) Applicant: Chang Fu Tsai, Taichung (TW)

(72) Inventor: Chang Fu Tsai, Taichung (TW)

(73) Assignee: Chang Fu Tsai, Taichung (TW)

( * ) Notice: Subject to any disclaimer, the term of this patent is extended or adjusted under 35 U.S.C. 154(b) by 110 days.

(21) Appl. No.: 13/872,146

(22) Filed: Apr. 28, 2013

(65) Prior Publication Data

US 2014/0321104 A1 Oct. 30, 2014

(51) Int. Cl.
*H01R 12/00* (2006.01)
*F21V 23/00* (2006.01)

(52) U.S. Cl.
CPC ..... *F21V 23/001* (2013.01)
USPC ..... 439/214

(58) Field of Classification Search
USPC ..... 439/214, 110, 505
See application file for complete search history.

(56) References Cited

U.S. PATENT DOCUMENTS

| | | | | | |
|---|---|---|---|---|---|
| 2,451,506 | A * | 10/1948 | O'Brien et al. | ..... | 439/214 |
| 2,952,829 | A * | 9/1960 | Grohsgal | ..... | 439/214 |
| 3,120,351 | A * | 2/1964 | Walter | ..... | 362/123 |
| 3,504,169 | A * | 3/1970 | Freeburger | ..... | 362/249.01 |
| 6,210,189 | B1 * | 4/2001 | Gantt | ..... | 439/214 |
| 6,775,676 | B1 * | 8/2004 | Briam et al. | ..... | 1/1 |
| 7,226,310 | B1 * | 6/2007 | Dickrell et al. | ..... | 439/505 |
| 2007/0173094 | A1 * | 7/2007 | Tan et al. | ..... | 439/214 |

* cited by examiner

*Primary Examiner* — Gary Paumen
(74) *Attorney, Agent, or Firm* — Andrew C. Cheng

(57) ABSTRACT

A structure of tree-shaped lighting decoration includes an extension cable assembly, which is a modularized assembly adapted to carry a regular voltage supplied from an electric main and has an end forming a cylindrical socket and an opposite end forming a cylindrical plug, a tree-segment tube having an end section forming a retention tubular section that has a reduced portion for positioning and retaining the cylindrical socket, an ancillary component including a conical body that forms therein a stepped bore that has a side opening. The stepped bore of the ancillary component and the cylindrical plug are respectively provided with mated dimple and bump for engaging each other. The ancillary component receiving the cylindrical plug therein is fit into an opposite end of the tree-segment tube to form a tree segment. Alternatively, the extension cable assembly can be used as a stand-alone device.

4 Claims, 5 Drawing Sheets

STRUCTURE OF TREE-SHAPED LIGHTING DECORATION

BACKGROUND OF THE INVENTION

1. Field of the Invention

The present invention relates to the field of tree-shaped decoration, such as a Christmas tree, and in particular to a structure of tree-shaped lighting decoration that allows electrical connection of a decorative light string to be established simultaneously with jointing of tree segments, wherein a tree-shaped lighting decoration is provided to allow electrical connection and mechanical jointing to be completed simultaneously or a modularized extension power cable that complies with regular voltage level supplied from for example an electric main is alternatively provided.

2. The Related Arts

Most of the tree-shaped decorations, which are often referred to as "Christmas trees", are supplied in a segmentalized form, namely being separated into a number of segments, so that a consumer needs to assemble or joint the segments of which at least some are in a tubular form or contain a tubular portion to form the tree-shaped decoration. After the segments are assembled together, a male connector provided on one tree segment is then plugged into a female connector provided on the next tree segment to establish electrical connection for a light string attached to or built with the tree segments. An alternative way for the electrical connection is done with an additional extension cord. Afterwards, plugging of the light string into a wall socket can then be made. It generally takes the consumer a lot of time to connect the parts of the light string attached to each tree segment.

For this type of tree-shaped lighting decoration that requires electrical connection to be additionally made between tree segments, it is also available in the market a structure that allows electrical connection to be done at the same time when tree segments are jointed to each other. However, such a structure is only available for low voltage level product and a transformer is provided for stepping down voltage supplied from an electric main before transmission of the stepped-down voltage to the tree-shaped decoration. The use of low voltage makes is less risky for use of the tree-shaped decoration. However, for products that use regular voltage level supplied from an electric main, no regulation is yet established for operation safety. In addition, those known products, electrical connection components are provided in a semi-finished formed and are generally combined with the tree segments in an inseparable manner. Thus, these electrical connection components cannot be used independently as a stand-alone device and are generally not in compliance with safety regulations of electrical products.

It is thus desired to provide a novel and unique structure that overcomes the above discussed problems.

SUMMARY OF THE INVENTION

An object of the present invention is to provide a structure of tree-shaped lighting decoration that allows electrical connection of decorative light to be established simultaneously with jointing of tree segments, in which a modularized extension cable assembly that complies with regular voltage level of electric main is provided and the extension cable assembly has opposite ends respectively forming a cylindrical socket and a cylindrical plug and is receivable and retained in a tree-segment tube to form a tree segment that, when jointed to another tree segment, allows simultaneous electrical connection between the tree segments and that also allows the extension cable assembly to be used as a stand-alone device as a flexible way of using the structure.

To achieve the above object, the present invention provides a structure of tree-shaped lighting decoration, comprising:

an extension cable assembly, which is a modularized assembly adapted to carry a regular voltage supplied from an electric main and comprises an extension cable, a cylindrical socket, and a cylindrical plug, the extension cable having an end electrically connected with the cylindrical socket and an opposite end electrically connected with the cylindrical plug, the cylindrical plug having a distal end on which an insertion tip is formed, the cylindrical socket having a distal end in which an insertion hole is formed, the insertion tip and the insertion hole being each axially symmetric;

a tree-segment tube, which has an end section forming a retention tubular section, the retention tubular section receiving the cylindrical socket therein and having a reduced portion that retains the cylindrical socket in position; and an ancillary component, which comprises a conical body that is reduced in a direction extending into the tree-segment tube, the ancillary component comprising a stepped bore formed axially therethrough delimited by a circumferential wall, the circumferential wall of the stepped bore comprising a side opening, the stepped bore of the ancillary component having an inside surface forming a dimple, the cylindrical plug having a circumferential surface forming a bump engageable with the dimple, whereby the ancillary component receives the extension cable into the stepped bore through the side opening so that the dimple of the ancillary component engages the bump of the cylindrical plug, the conical body of the ancillary component being then positionable and fixed in an end section of the tree-segment tube that is opposite to the retention tubular section to thereby form a three segment.

The cylindrical socket has a circumferential wall in which an electrical receptacle is formed and in electrical connection therewith.

The retention tubular section of the tree-segment tube comprises a receptacle opening formed therein to correspond to the electrical receptacle of the cylindrical socket. The circumferential wall of the cylindrical socket is provided with a plurality of threaded holes and the tree-segment tube is provided in a circumferential wall thereof with a plurality of through holes corresponding respectively to the threaded holes of the cylindrical socket, whereby screws are receivable through the through holes to engage the threaded holes for fixing the cylindrical socket in the retention tubular section with the electrical receptacle in registration with the receptacle opening.

To achieve the above object, the present invention also provides a structure of tree-shaped lighting decoration, comprising:

an extension cable assembly, which is a modularized assembly adapted to carry a regular voltage supplied from an electric main and comprises an extension cable, a cylindrical socket, and a cylindrical plug, the extension cable having an end electrically connected with the cylindrical socket and an opposite end electrically connected with the cylindrical plug, the cylindrical plug having a distal end on which an insertion tip is formed, the cylindrical socket having a distal end in which an insertion hole is formed, the insertion tip and the insertion hole being each axially symmetric; the cylindrical socket having a circumferential wall in which an electrical receptacle is formed and in electrical connection therewith; the extension cable assembly being usable as a stand-alone device.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

The present invention provides a structure of tree-shaped lighting decoration that allows electrical connection to be established simultaneously with jointing of segments of the tree.

Figure 1:
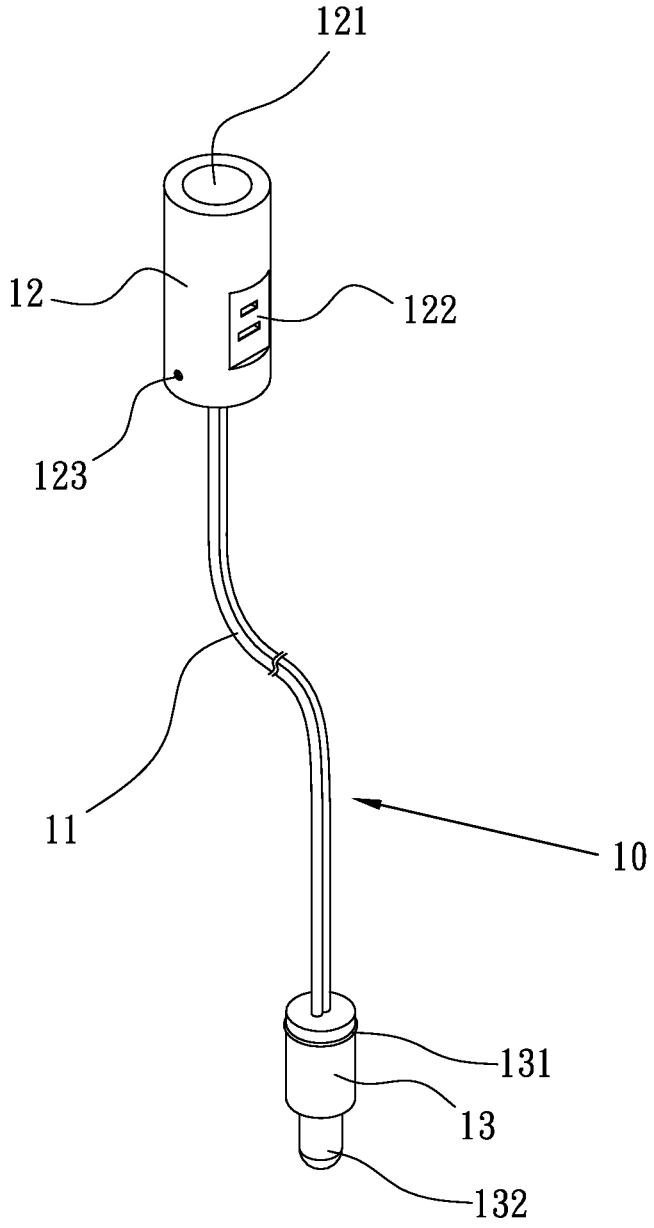
FIG. 1 is a perspective view showing an extension cable assembly that is a modularized assembly complying with a regular voltage level supplied from an electric main according to the present invention.

As shown in FIG. 1, the tree-shaped lighting decoration according to the present invention is used in combination with an extension cable assembly, generally designated at 10, which can be used as a stand-alone power cable or which can be used in combination with a tree-shaped decoration to be part of the decoration for supplying electrical power to a light string of the decoration.

The extension cable assembly 10, which is a modularized assembly that complies with a regular voltage level supplied from for example an electric main, comprises an extension cable 11, a cylindrical socket 12, and a cylindrical plug 13. The extension cable 11 has an end electrically connected with the cylindrical socket 12. The extension cable 11 also has an opposite end electrically connected with the cylindrical plug 13. The cylindrical plug 13 has a distal end that forms an insertion tip 132. The cylindrical socket 12 has a distal end in which an insertion hole 121 is formed. Both the insertion tip and the insertion hole are axially symmetric and are thus directionless in a plane perpendicular to the axial direction. The cylindrical socket 12 has a circumferential wall in which an electrical receptacle 122, which is similar to a wall outlet, is formed and in electrical connection with the cylindrical socket. The extension cable assembly 10 can be used individually as a stand-alone device.

Figure 2:
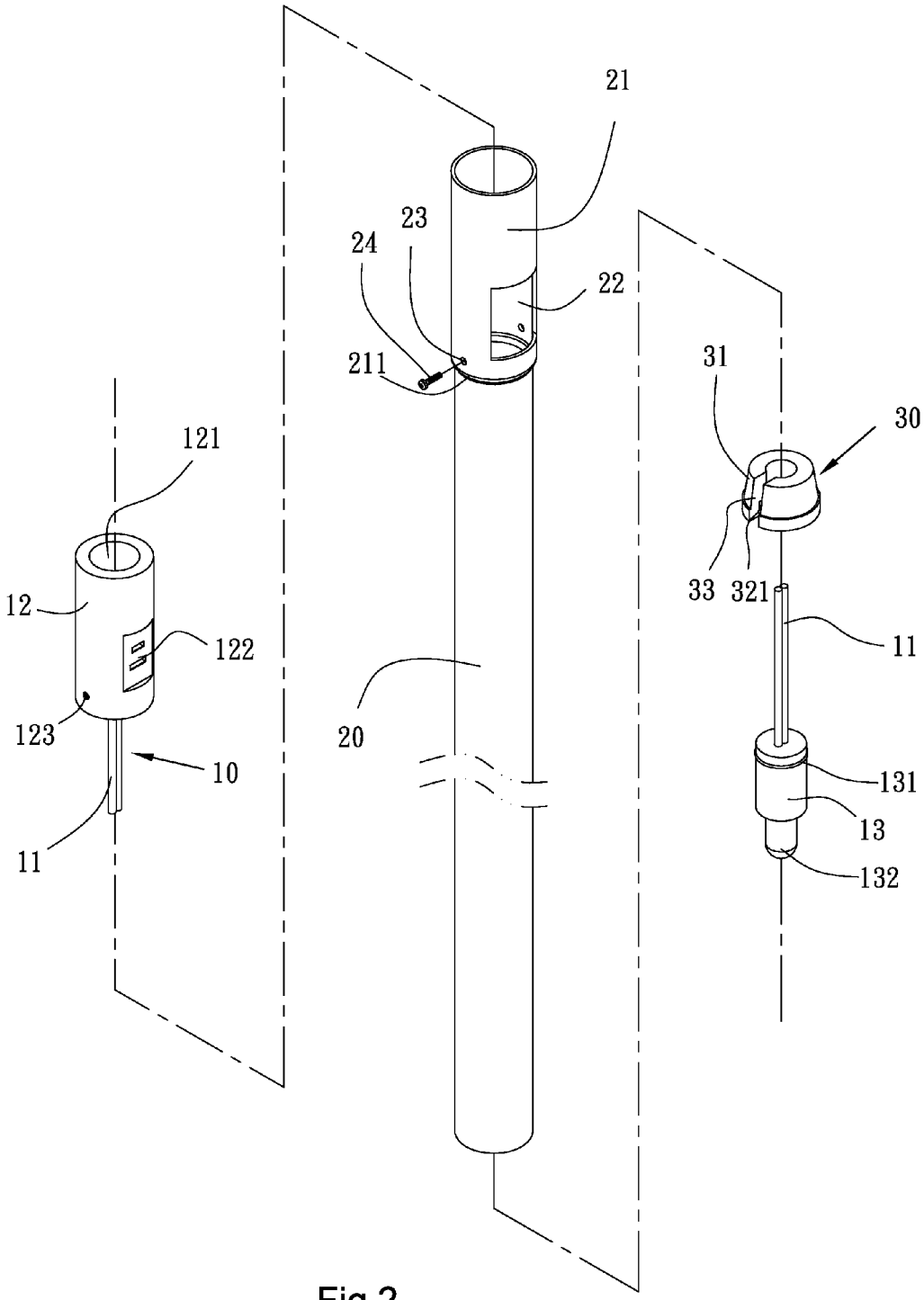
FIG. 2 is an exploded view showing a tree segment according to an embodiment of the present invention.
Figure 3:
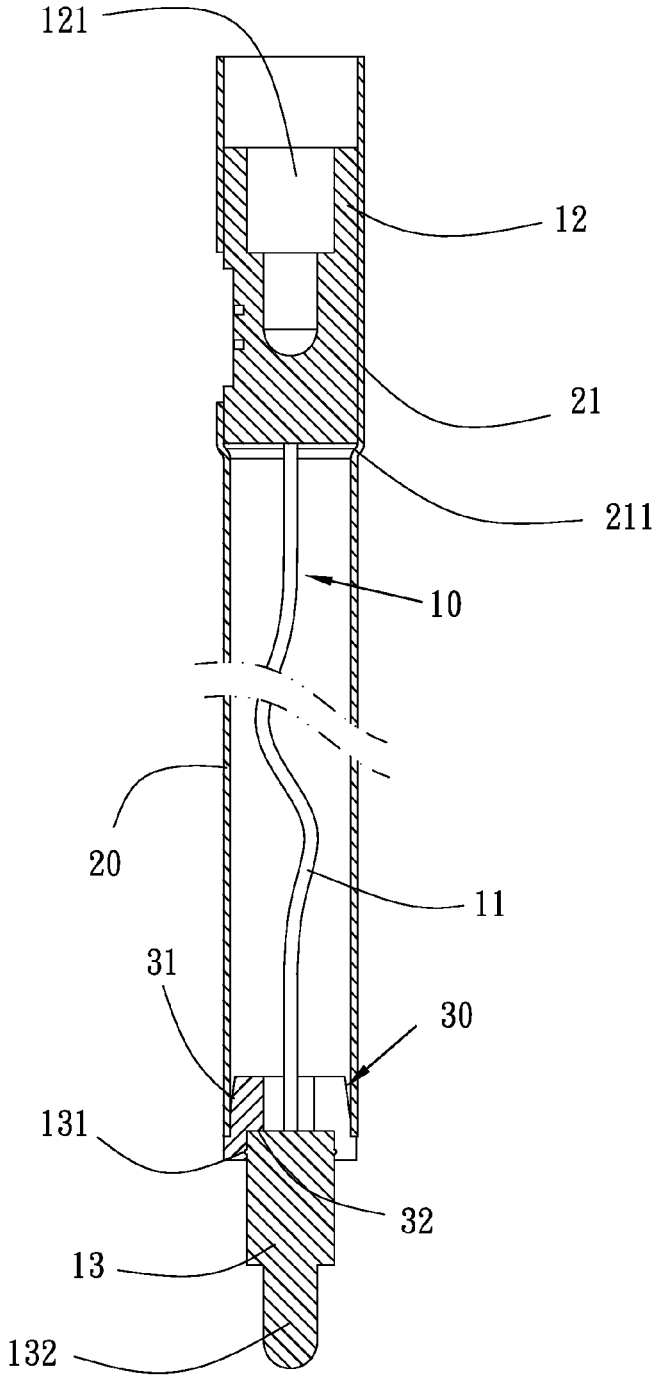
FIG. 3 is a cross-sectional view, in an assembled form, showing the tree segment according to the embodiment of the present invention.

Referring to FIGS. 2 and 3, the tree-shaped lighting decoration according to the present invention is constructed with one or more tree segments that are jointed to form a tree-shape decoration. The tree segment comprises the following components:

A tree-segment tube 20 has an end section that forms a retention tubular section 21. The retention tubular section 21 has an inner end forming a reduced portion 211, which is provided at the connection of the retention tubular section with the tree-segment tube for positioning and retaining the cylindrical socket 12 of the extension cable assembly therein.

An ancillary component 30 comprises a conical body 31 that is reduced in a direction extending into the tree-segment tube 20. The ancillary component 30 comprises a stepped bore 32 formed axially therethrough delimited by a circumferential wall. The circumferential wall of the stepped bore 32 comprises a side opening 33 communicating with the bore and outside the conical body. The stepped bore 32 of the ancillary component 30 has a reduced inner section and an expanded outer section between which the step is formed. The expanded outer section has an inside surface in which a dimple 321 is formed. The cylindrical plug 13 has a proximal end that is opposite to the insertion tip and is received partially in the expanded outer section of the stepped bore 32. The cylinder plug 13 has a circumferential surface on which a bump 131 is formed to correspond to and engage the dimple 321. As such, the ancillary component 30 receives the extension cable 11 and the cylindrical plug 13 into the stepped bore 32 thereof through the side opening 33 so that the dimple 321 of the ancillary component 30 engages the bump 131 of the cylindrical plug 13. The conical body 31 of the ancillary component 30 can then be positioned and fixed in an end section of the tree-segment tube 20 that is opposite to the retention tubular section 21 to thereby form a three segment.

As noted above, the cylindrical socket 12 of the extension cable assembly 10 that can be received and retained in the tree-segment tube to form a tree segment comprises an electrical receptacle 122 formed in a circumferential wall of the cylindrical socket 12.

The retention tubular section 21 of the tree-segment tube 20 comprises a receptacle opening 22 formed therein to correspond to the electrical receptacle 122 of the cylindrical socket 12. The circumferential wall of the cylindrical socket 12 is provided with a plurality of threaded holes 123 and the tree-segment tube 20 is provided in a circumferential wall thereof with a plurality of through holes 23 corresponding respectively to the threaded holes 123 of the cylindrical socket 12, whereby screws 24 may extend through the through holes to engage the threaded holes for fixing the cylindrical socket in the retention tubular section with the electrical receptacle 122 in registration with the receptacle opening 22.

Figure 4:
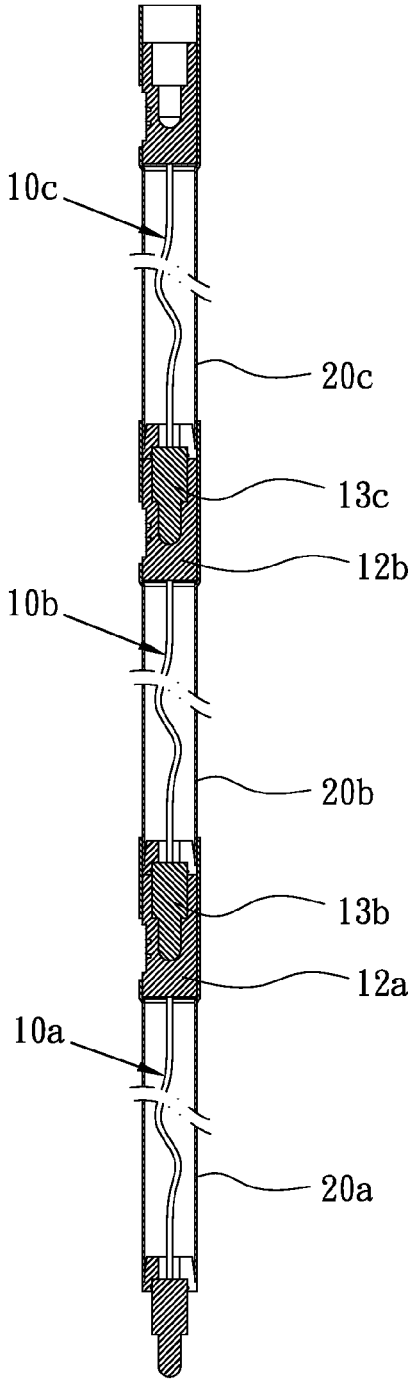
FIG. 4 is a cross-sectional view showing a plurality of tree segments according to the present invention jointed to each other.
Figure 5:
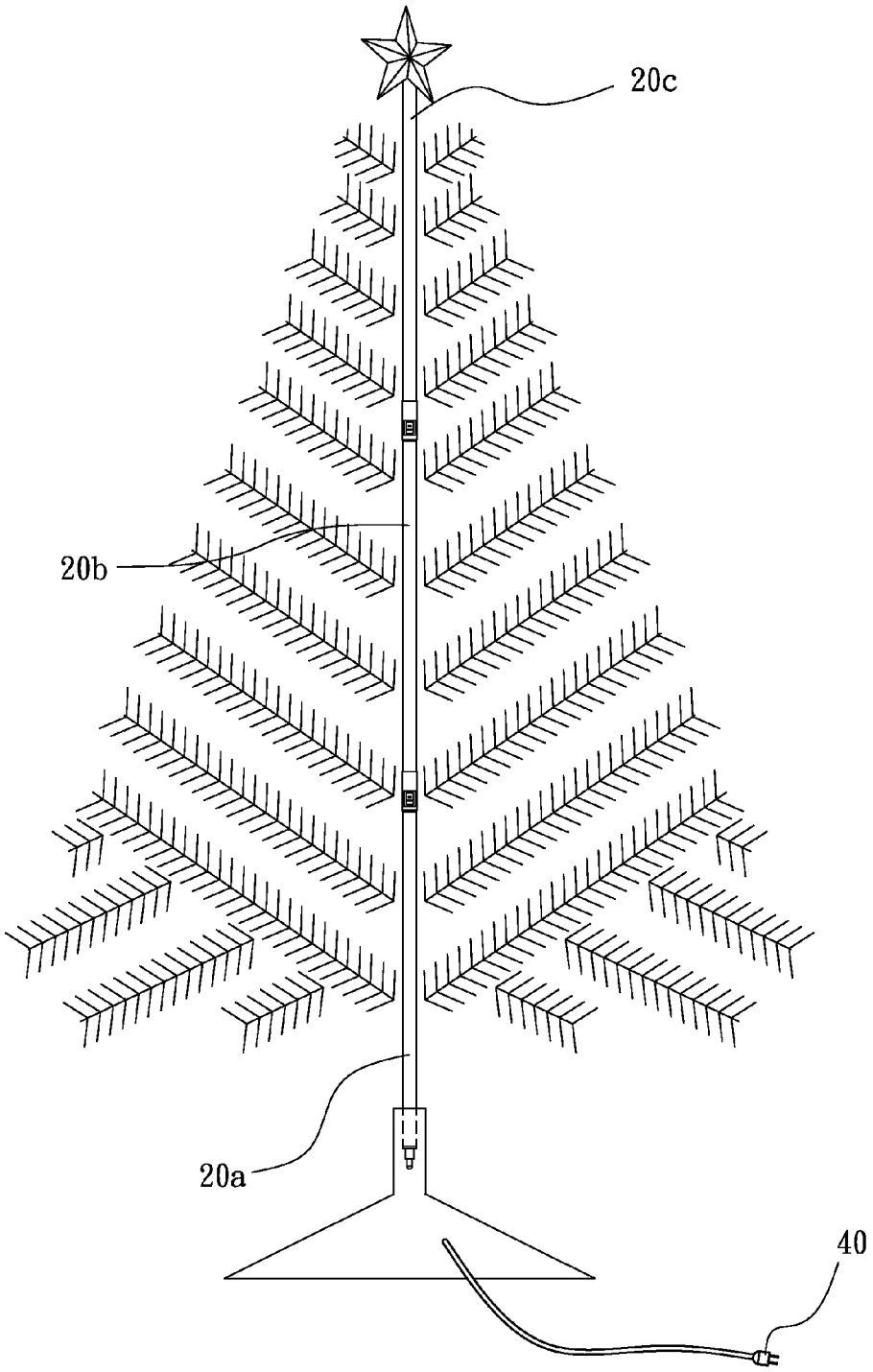
FIG. 5 is a schematic view illustrating a tree-shaped lighting decoration formed by jointing tree segments according to the present invention.

Referring to FIGS. 4 and 5, a number of the tree-segment tubes can be jointed to each other to form, at least partly, a tree-shaped decoration. An example that includes three tree-segment tubes 20*a*, 20*b*, 20*c* is illustrated for explanation only. Each of the tree-segment tubes 20*a*, 20*b*, 20*c* has a hollow interior receiving therein an extension cable assembly 10*a*, 10*b*, 10*c*. When the tree-segment tube 20*b* is jointed by inserting the cylindrical plug 13*b* thereof, in a directionless manner, into the cylindrical socket 12*a* of the tree-segment tube 20*a*, the tree-segment tubes 20*b*, 20*a* are mechanically jointed to each other, while the two extension cable assemblies 10*a*, 10*b* are electrically connected with each other. Afterwards, when the cylindrical plug 13*c* of the remaining tree-segment tube 20*c* is inserted, in a directionless manner, into the cylindrical socket 12*b* of the tree-segment tube 20*b* 之同時, the tree-segment tube 20*c*, 20*b*, electrical connection between the two extension cable assemblies 10*c*, 10*b* is simultaneously accomplished. As such, when a user joints the tree segments to each other to form the tree-shaped decoration, electrical connection between the tree segments is also completed. Therefore, a single terminal plug 40 that is pluggable into a wall outlet can supply electrical power to all the extension cable assemblies, without individually connecting each of the tree segments to a light string.

The present invention provides a tree-shaped lighting decoration that is of a modularized design, which allows of flexibility of logistics and manufacturing of the manufacturer without causing significant influence to an existing manufacturing process of Christmas tree. Further, the extension cable can be made in compliance with the existing safety regulation and can be used with the household electric main. The present invention, when applied to a Christmas tree, allows of easy assembling of the Christmas tree, without the need for seeking for the power connection for each individual tree segment. The directionless mating connectors also facilitate management for the user. The cylindrical plug and socket according to the present invention make themselves better fit to the tree-segment tubes. The ancillary component according to the present invention can used to ease the assembling process by first moving the plug through the tree-segment tube to such a condition where the cylindrical socket is received into and retained in the retention tubular section. Afterwards, the ancillary component receives the extension cable therein by passing through the side opening so as to have the ancillary component position and fix the cylindrical plug through engagement between dimple and bump. The ancillary component, after combined with the plug, is fit into and fixed to the tree-segment tube to complete the formation of a tree segment. Disassembling is also easy and can be done through an operation in exactly the revered way. The present invention also provides threaded holes in the cylindrical socket to work with through holes defined in the tree-segment tube allows the cylindrical socket to be properly positioned and secured by bolts. The present invention can also be useful without the ancillary component, provided that the tree-segment tube can receive and hold the socket and plug of the extension cable therein, which also achieves the same effect of mechanical jointing and electrical connection being done simultaneously. The present invention helps prevent the electrical cable of a tree-shaped lighting decoration or a Christmas tree from being exposed, which may affect the outside appearance of the tree-shaped lighting decoration.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A structure of tree-shaped lighting decoration, comprising:

an extension cable assembly, which is a modularized assembly adapted to carry a regular voltage supplied from an electric main and comprises an extension cable, a cylindrical socket, and a cylindrical plug, the extension cable having an end electrically connected with the cylindrical socket and an opposite end electrically connected with the cylindrical plug, the cylindrical plug having a distal end on which an insertion tip is formed, the cylindrical socket having a distal end in which an insertion hole is formed, the insertion tip and the insertion hole being each axially symmetric;

a tree-segment tube, which has an end section forming a retention tubular section, the retention tubular section receiving the cylindrical socket therein and having a reduced portion that retains the cylindrical socket in position; and an ancillary component, which comprises a conical body that is reduced in a direction extending into the tree-segment tube, the ancillary component comprising a stepped bore formed axially therethrough delimited by a circumferential wall, the circumferential wall of the stepped bore comprising a side opening, the stepped bore of the ancillary component having an inside surface forming a dimple, the cylindrical plug having a circumferential surface forming a bump engageable with the dimple, whereby the ancillary component receives the extension cable into the stepped bore through the side opening so that the dimple of the ancillary component engages the bump of the cylindrical plug, the conical body of the ancillary component being then positionable and fixed in an end section of the tree-segment tube that is opposite to the retention tubular section to thereby form a three segment.

2. The structure of tree-shaped lighting decoration as claimed in claim 1, wherein the cylindrical socket has a circumferential wall in which an electrical receptacle is formed and in electrical connection therewith.

3. The structure of tree-shaped lighting decoration as claimed in claim 2, wherein the retention tubular section of the tree-segment tube comprises a receptacle opening formed therein to correspond to the electrical receptacle of the cylindrical socket, the circumferential wall of the cylindrical socket being provided with a plurality of threaded holes, the tree-segment tube being provided in a circumferential wall thereof with a plurality of through holes corresponding respectively to the threaded holes of the cylindrical socket, whereby screws are receivable through the through holes to engage the threaded holes for fixing the cylindrical socket in the retention tubular section with the electrical receptacle in registration with the receptacle opening.

4. A structure of tree-shaped lighting decoration, comprising:

an extension cable assembly, which is a modularized assembly adapted to carry a regular voltage supplied from an electric main and comprises an extension cable, a cylindrical socket, and a cylindrical plug, the extension cable having an end electrically connected with the cylindrical socket and an opposite end electrically connected with the cylindrical plug, the cylindrical plug having a distal end on which an insertion tip is formed, the cylindrical socket having a distal end in which an insertion hole is formed, the insertion tip and the insertion hole being each axially symmetric; the cylindrical socket having a circumferential wall in which an electrical receptacle is formed and in electrical connection therewith; the extension cable assembly being usable as a stand-alone device.

* * * * *